US008561856B2

(12) United States Patent
Kuperus

(10) Patent No.: US 8,561,856 B2
(45) Date of Patent: Oct. 22, 2013

(54) VALVE ASSEMBLY WITH POSITIONING MEANS FOR A KEG WITH AN INNER BAG

(75) Inventor: Johan Bernard Kuperus, Hoogeveen (NL)

(73) Assignee: Koninklijke Philips N.V., Eindhoven (NL)

( * ) Notice: Subject to any disclaimer, the term of this patent is extended or adjusted under 35 U.S.C. 154(b) by 1823 days.

(21) Appl. No.: 11/596,827

(22) PCT Filed: May 12, 2005

(86) PCT No.: PCT/IB2005/051557

§ 371 (c)(1),
(2), (4) Date: Nov. 16, 2006

(87) PCT Pub. No.: WO2005/113414

PCT Pub. Date: Dec. 1, 2005

(65) Prior Publication Data

US 2008/0061086 A1 Mar. 13, 2008

(30) Foreign Application Priority Data

May 19, 2004 (EP) ..... 04102221

(51) Int. Cl.
*B65D 83/00* (2006.01)

(52) U.S. Cl.
USPC ..... 222/400.7; 222/386.5; 222/387; 222/95; 222/105; 141/346

(58) Field of Classification Search
USPC ..... 222/400.7, 94, 95, 105, 386.5, 387, 222/389, 394; 141/346, 348, 349; 137/212, 137/320, 322
See application file for complete search history.

(56) References Cited

U.S. PATENT DOCUMENTS

| | | | | |
|---|---|---|---|---|
| 3,374,927 | A * | 3/1968 | Schmidt | 222/400.7 |
| 3,758,008 | A | 9/1973 | Johnston | |
| 3,908,861 | A | 9/1975 | Johnston | |
| 3,913,608 | A | 10/1975 | Johnston et al. | |
| 5,335,821 | A * | 8/1994 | Osgar | 222/400.7 |
| 6,015,068 | A * | 1/2000 | Osgar et al. | 222/400.7 |
| 6,237,809 | B1 * | 5/2001 | Kawai et al. | 222/400.7 |
| 6,516,839 | B1 * | 2/2003 | Timp et al. | 141/347 |
| 6,942,127 | B2 * | 9/2005 | Raats | 222/400.7 |

FOREIGN PATENT DOCUMENTS

| | | | |
|---|---|---|---|
| NL | 1014081 | | 6/2000 |
| WO | 0076907 | A1 | 12/2000 |
| WO | 03050031 | A1 | 6/2003 |
| WO | WO 03/050031 | | 6/2003 |
| WO | WO 2004050535 | A2 * | 6/2004 |
| WO | 2004099847 | A1 | 11/2004 |

* cited by examiner

*Primary Examiner* — J. Casimer Jacyna

(57) ABSTRACT

A beverage valve assembly includes a bottom wall section; a tubular part extending downward from the bottom wall section; an outer apron extending upward from the bottom wall section; and at least one positioning device. The tubular part has a top opening to receive a dispensing element. The top opening is arranged in the middle section of the upper outer surface of the bottom wall, and the tubular part has an upper inner tubular wall section with at least one sealing surface. The outer upward standing apron is arranged at a distance from the top opening of the tubular part. The bottom wall includes at least one valve positioned between the top opening of the tubular part and an inner sidewall section of the outer upward standing apron. The positioning device has at least one opening or gap.

12 Claims, 6 Drawing Sheets

VALVE ASSEMBLY WITH POSITIONING MEANS FOR A KEG WITH AN INNER BAG

The present invention relates to a beverage valve assembly and a beverage valve assembly arranged at a container with an inner bag for receiving beverage, in particular carbonated beverage such as beer. Further, the present invention is directed to a connecting element for engaging a beverage valve assembly. The present invention is further directed to a tapping device comprising a connecting element. The present invention is also directed to a beverage tapping apparatus comprising a replaceable container with a beverage valve assembly releasably engaged with a connecting element of a tapping device as well as to a method for dispensing beer from a beverage tapping apparatus.

A valve assembly for use in beverage containers with an inner bag for receiving beverage is described in WO-A1 03/050031. In WO-A1 03/050031, a valve assembly of a container is described in which an inner bag is provided for receiving beverage, in particular carbonated beverage such as beer, wherein a beverage valve is provided. On the side facing the inner bag, the beverage valve is provided with an interface with the inner space of the bag and, on the opposite side, the beverage valve is provided with means for operation of the beverage valve by a tapping device in which the container can be accommodated. The beverage valve, on said opposite side, is surrounded by a standing first apron which is gas-tight, while along the outer side of said first apron, at a distance therefrom, a second apron is arranged, which is also gas-tight. Between the first and second aprons, a bottom wall with at least one gas passage opening is provided which during operation is in communication with the space enclosed between the inner bag and a container surrounding the inner bag. During operation, a collar of a connecting element abuts, in a gastight and liquid-tight manner, against the second apron, while a dispensing element abuts, in a gastight and liquid-tight manner, against the first apron, so that between the two aprons a chamber is formed through which gas under pressure can be forced through said at least one gas passage opening, separately from the beverage.

However, a drawback of the valve assembly of WO-A1 03/050031 resides in that the first apron as well as the second apron are in an upright position, and thus can be damaged if the connecting element is displaced when the parts are attached to each other. If damaged, then during operation, the collar of said connecting element does not abut against the second apron in a gastight and liquid-tight manner. Bearing in mind that the aprons are fragile, a displacement when they are attached to each other can easily cause twisting or even breakage of the first and/or the second apron, leading to leakage. Further, the dispensing element abuts in a gastight and liquid-tight manner against the first apron only, thus damage as described above leads to gas and liquid leakage. Furthermore, a gastight and liquid-tight sealing is provided only for the first apron to the dispensing element and for the second apron to the collar of the connecting element. Therefore, leakage of at least only one apron leads to a malfunction of the entire valve assembly. Moreover, if the dispensing element is not in place, gas and liquid leakage occurs at the first apron as a result of gas and liquid leakage from the chamber formed between the first and second aprons.

The object of the invention is to provide a valve assembly, in which at least most of the disadvantages mentioned have been avoided. More in particular, the object of the invention is to provide a valve assembly for containers with an inner bag, permitting a gas-tightly and liquid-tight connecting dispensing element to be safely connected to a beverage valve arrangement in a gastight and liquid-tight manner.

A first object of the invention is to provide a beverage valve assembly, in which at least most of the disadvantages mentioned have been avoided.

This object is achieved by a beverage valve assembly, comprising:

a bottom wall section;

a tubular part extending downward from the bottom wall section;

an outer apron standing up from the bottom wall section; and at least one positioning means, wherein the tubular part has a top opening to receive a dispensing element, which top opening is arranged preferably in the middle section of the upper outer surface of the bottom wall, and the tubular part has an upper inner tubular wall section with at least one sealing surface, and the outer standing apron is arranged at a distance from the top opening of the tubular part, wherein the bottom wall section comprises at least one valve positioned between the top opening of the tubular part and an inner sidewall section of the outer standing apron, and wherein at least one positioning means has at least one opening and/or at least one opening is present between at least two positioning means, wherein the outer side surface of at least one positioning means is larger than the outer side surface of at least one opening of a positioning means and/or of at least one opening between two positioning means.

The outer standing apron can be used during operation to abut against a first collar of a connecting element in a gastight and liquid-tight manner. Preferably, a first collar of a connecting element can abut, in a gastight and/or liquid-tight manner, against the first sealing surface of the inner side of said apron.

Further, the tubular part of the beverage valve assembly, the inside of which preferably has a step-like and/or shoulder-like form, has an upper inner tubular wall section with at least two sealing surfaces. The structural measurements of the specially designed sealing surfaces arranged at the upper inner tubular wall section provide that a second collar of a connecting element can abut against the second sealing surface of the inner tubular part in a gastight and liquid-tight manner, while a dispensing element can abut against the third sealing surface of the inner tubular part in a gastight and liquid-tight manner.

The beverage valve assembly according to the present invention has the advantage that even a displacement of the connecting element with respect to the beverage valve assembly cannot damage a sealing component and thus a displacement does not lead to gas and liquid leakage. Furthermore, a gastight and liquid-tight seal is provided inside the inner tubular wall section (a) by at least said second collar of the connecting element, which abuts against the second sealing surface of the inner tubular part in a gastight and liquid-tight manner and (b) by said dispensing element which abuts against the third sealing surface of the inner tubular part in a gastight and liquid-tight manner.

Therefore, even leakage at the second sealing surface or at the third sealing surface does not lead to a malfunction of the entire valve assembly, and thus gas and beverage are not contaminated by each other at the inner tubular part. Moreover, if the dispensing element is not in place, gas leakage cannot occur at the inner tubular part, because the second collar of the connecting element abuts, in a gastight and liquid-tight manner, against the second sealing surface of the inner tubular part that is separate from the dispensing element.

The following description of the present invention makes clear that the valve assembly according to the present invention can provide a releasable connection of the connecting dispensing element to the beverage valve arrangement.

Further, the valve assembly according to the present invention can simultaneously provide gastight and liquid-tight sealing of the connecting dispensing element to the beverage valve arrangement in order to provide at the same time a separate gas passage and beverage passage.

Further, the valve assembly according to the present invention can provide gastight and liquid-tight sealing of the connecting dispensing element to the beverage valve arrangement, whereby the beverage passage is sealed in a gastight and liquid-tight manner with respect to the gas chamber before the chamber of the gas passage is sealed in a gastight and liquid-tight manner.

Further, the valve assembly according to the present invention can provide that the air- or $CO_2$-valve is not accidentally pushed open during operation if the seals of a dispensing element connected to the beverage valve arrangement are displaced.

The beverage valve assembly according to the present invention can comprise at least one positioning means with at least one opening in the form of a gap, preferably a vertical gap. At least one positioning means with an opening and/or an opening between at least two positioning means according to the present invention can be arranged along the inner sidewall section of said apron and at a distance therefrom. The at least one positioning means preferably is a standing wall, more preferably the positioning means is a standing wall surrounding the top opening of the tubular part. Most preferably, at least one positioning means with an opening, and/or with an opening between at least two positioning means according to the present invention, has an annular shape or the form of a ring.

It is preferred that two positioning means form a ring, and openings are formed at two positions between the two positioning means, which openings can be located parallel to each other and more preferably the openings have the form of a vertical gap.

It is further preferred that three, four or at least five positioning means are arranged on the bottom of the beverage valve assembly, wherein at least one positioning means has at least one opening and/or at least one opening is arranged between at least two positioning means, which openings can, but need not be located parallel to each other, and more preferably the openings have the form of a vertical gap.

It is preferred that the two positioning means have the same form. However, the positioning means can differ from each other.

It is also preferred that the four positioning means are separated by an opening between them.

The number of positioning means and openings are limited only by the fact that, in any case, the outer side surface of at least one positioning means is larger than the outer side surface of at least one opening of said positioning means and/or of at least one opening between two positioning means.

The beverage valve assembly according to the present invention can comprise at least one positioning means with an outer side surface in the range of $>0.5\ cm^2$ and $<30\ cm^2$, preferably $>1\ cm^2$ and $<20\ cm^2$, more preferably $>0\ cm^2$ and $<15\ cm^2$ and most preferably $>0\ cm^2$ and $<12\ cm^2$.

The term "outer side surface" as used in the description means the outer upper side surface.

At least one positioning means is used to ensure that the connecting element cannot be displaced, thus, the positioning means serves as a guiding means. Further, at least one positioning means is used to ensure that the tubular dispensing element of a beverage dispensing system engages into the tubular part of the beverage valve assembly, and thus cannot be displaced.

It is most preferred that at least one positioning means with an opening and/or an opening between at least two positioning means according to the present invention does not have a sealing function but a guiding function to ensure that the connecting element properly fits to the beverage valve assembly at the time of connection and use.

The at least one and/or two positioning means engage a recess formed between the first and second collars of the connecting element. The thickness and width of at least one positioning means is chosen so that it fits into the recess of said connecting element when the beverage valve assembly and the connecting element are properly connected to each other.

It may be preferred that, if the beverage valve assembly and the connecting element are connected to each other for use, the at least one positioning means according to the present invention does not abut against at least a sidewall section of the first collar, nor against at least a sidewall section of the second collar and/or against at least a bottom wall section of the recess of the connecting element.

The beverage valve assembly according to the present invention will now be described in more detail.

The beverage valve assembly according to the present invention comprises at least one apron, however, in its most preferred form it comprises one apron. The inner sidewall section of the apron serves as a first sealing surface, so that a connecting element is able to abut, in a gastight and liquid-tight manner, against the first sealing surface of the inner sidewall section of said apron. By virtue of the use of one apron only, in particular if the apron is arranged near to or at the outer edge of the beverage valve assembly, the danger of demolition, twisting or even cracking, which leads to a malfunction during use, can be significantly reduced or avoided.

It is preferred that the apron is concentrically arranged, so that it can be engaged internally by a collar of the connecting element. However, it may be possible that the collar, preferably the first collar, comprises a recess, so that the apron engages and abuts against the recess of the first collar in a gastight and liquid-tight manner. Nevertheless, a construction is preferred in which the inner sidewall section of the apron of the beverage valve assembly functions as a first sealing surface, so that an outer sidewall of a connecting element is able to abut, in a gastight and liquid-tight manner, against the first sealing surface of the inner sidewall section of said apron.

The apron and at least one positioning means with an opening and/or an opening between at least two positioning means of the beverage valve assembly according to the present invention is preferably arranged concentrically with respect to the top opening. A concentric arrangement provides, among other advantages, a better gastight and liquid-tight sealing of the apron of the beverage valve assembly against the first collar of the connecting element. Further, a concentric arrangement of at least one positioning means with an opening and/or an opening between at least two positioning means according to the present invention allows improved assembly of the beverage valve assembly with the connecting element and reduces or avoids the danger of a displacement associated with leakage. Further, a concentric arrangement of at least one positioning means with an opening and/or an opening between at least two positioning means according to the present invention can provide that the air-valve and/or $CO_2$-valve is not accidentally pushed open during operation, because a displacement of the dispensing element is avoided.

The inner tubular part of the beverage valve assembly according to the present invention comprises preferably at least one sealing surface, and more preferably at least a first sealing surface and a second sealing surface. Said first sealing surface can be arranged flush with, and above or below the upper outer surface of the bottom wall section of the beverage valve assembly.

Preferably, the sealing surface(s) of the inner tubular wall section is (are) annularly shaped. More preferably, the first sealing surface is annularly shaped.

More preferably, the inner tubular wall section of said upper tubular part has at least two sealing surfaces, which are preferably annularly shaped.

It is preferred that the diameter of the opening of the tubular part within the annularly shaped first step or first shoulder is substantially larger than the diameter of the opening of the tubular part within the annularly shaped second step or second shoulder.

Inside the tubular part, preferably below the second step or second shoulder, a beverage valve can be arranged, for example to control the beverage flow.

Further, the bottom wall of the beverage valve assembly according to the present invention can comprise two valves, of which preferably one valve is connected to the passage to the space between the keg and the bag and the other valve is connected to the passage to the inner part of the bag, and more preferably the valve connected to the passage to the space between the keg and the bag is an air valve and/or the valve connected to the passage to the inner part of the bag is a $CO_2$-valve, and preferably the valves are radially spaced apart, located on the same normal to the circle and equidistant from the center point, and they are arranged in the bottom wall section between the inner wall section of said outer apron and the opening of the tubular part or within the bottom wall section between the inner wall section of said outer apron and the outer wall section of said at least one inner positioning means according to the present invention.

In the following, specification data is given for the beverage valve assembly according to the present invention. It is noted that the actual dimensions of the beverage valve assembly according to the present invention are selected such that the beverage valve assembly fits to the connecting element as well as to the dispensing element without a malfunction. Thus, data is selected from the ranges given below, in such a way that the beverage valve assembly fits to the other parts described, such as the connecting element, the dispensing element etc. without causing a malfunction.

The term "fits" as used in the present description means that the dimensions of the parts are selected so that during use proper functioning is assured.

The internal diameter of the standing apron can be 10 mm to 100 mm, preferably 20 mm to 60 mm, and more preferably 30 mm to 50 mm; and the height of the apron measured from the upper outer surface of the bottom adjacent to the apron can be 0.5 mm to 50 mm, preferably 3 mm to 30 mm, and more preferably 5 mm to 25 mm; and the thickness of the apron is 0.1 mm to 15 mm, preferably 0.5 mm to 10 mm, and more preferably 1 mm to 5 mm.

The internal diameter of at least one standing positioning means according to the present invention can be 0.5 mm to 50 mm, preferably 5 mm to 30 mm, and more preferably 10 mm to 25 mm; and the height of at least one positioning means according to the present invention, measured from the upper outer surface of the bottom adjacent to the apron, can be 0.5 mm to 50 mm, preferably 3 mm to 30 mm, and more preferably 5 mm to 25 mm; and the thickness of at least one positioning means according to the present invention can be 0.1 mm to 15 mm, preferably 0.5 mm to 10 mm, and more preferably 1 mm to 5 mm.

The diameter of the top opening of the apron facing away from the bottom wall can be 0.5 mm to 50 mm, preferably 3 mm to 30 mm, and more preferably 5 mm to 25 mm; and/or the diameter of the top opening of at least one positioning means according to the present invention facing away from the bottom wall can be 0.5 mm to 50 mm, preferably 3 mm to 30 mm, and more preferably 5 mm to 25 mm.

The internal diameter of the top opening of the tubular part and/or the diameter of the opening within the annularly shaped first step or first shoulder of the tubular part can be 0.5 mm to 50 mm, preferably 3 mm to 30 mm, and more preferably 5 mm to 25 mm; and/or the diameter of the opening within the annularly shaped second step or second shoulder of the tubular part can be 0.5 mm to 50 mm, preferably 3 mm to 30 mm, and more preferably 5 mm to 25 mm.

The width of the upper outer surface of the annularly shaped first step or first shoulder can be 0.5 mm to 50 mm, preferably 3 mm to 30 mm, and more preferably 5 mm to 25 mm; and/or the width of the upper outer surface of the annularly shaped second step or second shoulder can be 0.5 mm to 50 mm, preferably 3 mm to 30 mm, and more preferably 5 mm to 25 mm.

The difference in altitude between the upper outer surface of the annularly shaped first step or first shoulder and the upper outer surface of the annularly shaped second step or second shoulder can be 0.1 mm to 50 mm, preferably 1 mm to 25 mm, and more preferably 2 mm to 20 mm.

A second object of the present invention is related to a connecting element. In particular, it relates to a connecting element for engaging a beverage valve assembly.

The connecting element is used for engaging a beverage valve assembly in order to provide a separate gas and beverage passage. The connecting element can comprise a first outer collar and a second inner collar. The first and the second collar of the connecting element preferably have a circular shape. It is preferred that the first outer collar has at least one gas passage opening and/or the second inner collar has a continuous opening for receiving a dispensing element. The first outer collar and/or the second inner collar can be arranged, preferably concentrically, at a distance from each other. Between the first outer collar and the second inner collar a recess, preferably concentrically arranged, can be formed.

A connecting element for engaging with a beverage valve assembly according to the present invention comprises preferably a first collar and a second collar, wherein between the first and the second collar a recess with a bottom wall is formed. The shape of the recess can be such that at least one positioning means according to the present invention can engage into the recess, while at least one positioning means does not contact the bottom wall and/or a sidewall of the recess if it fits properly. However, the form of at least one positioning means can be designed in such a way that at least one positioning means contacts the bottom wall and/or a sidewall of the recess. However, it is most preferred that the recess does not abut, in a gastight and liquid-tight manner, against an outer sidewall of at least one positioning means.

The second inner collar can project above the first outer collar. This has the advantage that the second inner collar can engage into the tubular part of the beverage valve assembly, said second collar preferably being concentrically arranged.

More preferably, the height of the second inner collar is adjusted so that it abuts against the first sealing surface of the inner tubular part of the beverage valve assembly in a gastight and liquid-tight manner, when the connecting element and the beverage valve assembly are releasably joined to each other.

Most preferably, the connecting element and the beverage valve assembly are removably interconnected.

The first collar and/or the second collar can have at least one hole for a gas passage. However, it is most preferred that the first outer collar has one continuous hole, also referred to as "through-hole" only for a gas passage. Air under pressure can flow through this gas passage. The first collar of the connecting element should be connected to the beverage valve assembly in such a way that a gas passage from the through-hole of the first collar to the passage to the space between the keg and the bag is formed via the gas-valve.

The second collar has at least one continuous hole, also called "through-hole" through which the dispensing element is passed. Preferably, the "through-hole" of the second collar is arranged in the center of the second collar.

Further, the second collar with a through-hole in the center can have a step at the upper section of the opening of said through-hole onto which the dispensing element can be held.

The connecting element and the beverage valve assembly can be removably interconnected in such a way that during operation a first collar of the connecting element according to the present invention abuts, in a gastight and liquid-tight manner, against the first sealing surface of the inner side of the apron of the beverage valve assembly, whereby a gas chamber can be formed and a second collar of said connecting element abuts, in a gastight and liquid-tight manner, against the second sealing surface of the tubular part of the beverage valve assembly. A gas chamber is formed, if the top of the surface of the first collar does not contact, or only partly contacts, the bottom wall section between the apron and at least one positioning means according to the present invention or tubular part of the beverage valve assembly. In the case where a gas chamber is formed, the second collar which abuts against the second sealing surface of the tubular part in a gastight and liquid-tight manner can also seal the gas chamber.

The second inner collar provides a "through-hole" for receiving a dispensing element. The through-hole of the second inner collar of the connecting element is preferably arranged in the center of the second collar. While a dispensing element abuts against the third sealing surface of the inner tubular part in a gastight and liquid-tight manner, the connecting element is positioned so that the gas passage opening of the first collar is in communication with the gas valve, so that gas under pressure can be forced through said at least one gas passage opening, separately from the beverage.

Further, the first outer collar of the connecting element according to the present invention can provide at its upper outer surface, preferably at or near to the outer edge of its upper outer surface, at least one flexible sealing means; and/or the second inner collar of the connecting element can provide at its upper outer surface, preferably at or near to the outer edge of its upper outer surface, at least one flexible sealing means.

The flexible sealing means can be an o-ring or any other flexible sealing material. Preferably the sealing material can be rubber, Teflon or the like.

In the following, specification data is given for the connecting element according to the present invention. It is noted that the actual dimensions of the connecting element are adjusted in such a way that the connecting element fits, most preferably replaceably fits, to the beverage valve assembly as well as to dispensing element during use, without causing a malfunction. Thus, data is selected from the ranges given below, in such a way that a proper fit to the other parts described, such as the beverage valve assembly, the dispensing element etc., is assured without causing a malfunction. In other words, the ranges given below are selected so that the connecting element fits properly.

The internal diameter of the first outer collar can be 1 mm to 100 mm, preferably 20 mm to 60 mm, and more preferably 30 mm to 50 mm; and the height of the first outer collar, as measured from the bottom of the recess adjacent to the first outer collar, can be 0 mm to 50 mm, preferably 5 mm to 30 mm, and more preferably 10 mm to 25 mm; and the thickness of the first outer collar can be 0.1 mm to 30 mm, preferably 1 mm to 20 mm, and more preferably 2 mm to 15 mm.

The internal diameter of the second inner collar can be 0.1 mm to 50 mm, preferably 2 mm to 35 mm, and more preferably 5 mm to 25 mm; and the height of the second inner collar, as measured from the bottom of the recess adjacent to the second inner collar, can be 0 mm to 50 mm, preferably 2 mm to 40 mm, and more preferably 5 mm to 30 mm; and the thickness of the second inner collar can be 0.1 mm to 15 mm, preferably 0.2 mm to 10 mm, and more preferably 0.5 mm to 5 mm.

The internal diameter of the top opening of the first inner collar facing the beverage valve assembly can be 0.1 mm to 50 mm, preferably 2 mm to 35 mm, and more preferably 5 mm to 25 mm; and/or the internal diameter of the top opening of the through-hole of the second inner collar facing the beverage valve assembly can be 0.1 mm to 50 mm, preferably 2 mm to 35 mm, and more preferably 5 mm to 25 mm.

The distance from the inner sidewall of the first collar to the outer sidewall of the second collar can be 0.5 mm to 50 mm, preferably 2 mm to 20 mm, and more preferably 5 mm to 15 mm.

A third object according to the present invention relates to a tapping device.

The tapping device comprises a connecting element according to the present invention. The tapping device according to the present invention is provided with means for operation of a beverage valve assembly to which a container is releasably engaged.

The second inner collar of the connecting element of said tapping device has a through-hole for receiving the tubular dispensing element. The tubular dispensing element can abut against the third sealing surface of the inner tubular part in a gastight and liquid-tight manner.

The tubular dispensing element can be a cartridge unit with an inner channel or pipe for the dispensation of a beverage. That cartridge unit can comprise preferably a first part, facing the container, which is made of a rigid material, and a second part, facing in the opposite direction, which is made of a flexible material.

The tubular dispensing element of the cartridge unit projects above the second inner collar. Preferably, the tubular dispensing element of the cartridge unit extends over the inner edge of the top opening of the second collar facing the beverage valve assembly. The height of the tubular dispensing element can be >0 mm to 100 mm, preferably 5 mm to 60 mm, and more preferably 20 mm to 50 mm.

A fourth object according to the present invention relates to a beverage valve assembly according to the present invention arranged on a container in which an inner bag is provided for receiving beverage, in particular carbonated beverage such as beer. The beverage valve assembly is arranged on said container, and a connecting element or a tapping device as already described can be fitted to said beverage valve assembly during operation.

The beverage valve assembly according to the present invention is designed in such a way that during operation a first collar of the connecting element abuts, in a gastight and liquid-tight manner, against the first sealing surface of the inner side of said apron, and/or a second collar of said connecting element abuts, in a gastight and liquid-tight manner, against the second sealing surface of the tubular part, and/or a dispensing element abuts, in a gastight and liquid-tight manner, against the third sealing surface of the inner tubular part. On the side facing the inner bag, the beverage valve assembly is provided with a gas passage opening to the inner space of the bag and on the opposite side it is surrounded by an outer standing apron which is gas-tight, while along the inner sidewall of said apron, which functions as a first sealing surface, and at a distance therefrom at least one inner positioning means according to the present invention is arranged, and between said apron and said at least one positioning means with an opening and/or an opening between at least two positioning means a bottom wall with at least one gas valve is provided which during operation is in communication with the space enclosed between the inner bag and the container surrounding the inner bag via a gas passage, and a tubular part for receiving a dispensing element is arranged in the center, optionally surrounded by a standing positioning means with an opening and/or an opening between at least two positioning means, which inner tubular part comprises a second sealing surface and a third sealing surface, the valve assembly being such that during operation a first collar of a connecting element according to the present invention abuts in a gastight and liquid-tight manner against the first sealing surface of the inner side of said apron and a second collar of said connecting element abuts, in a gastight and liquid-tight manner, against the second sealing surface of the tubular part, while a dispensing element abuts, in a gastight and liquid-tight manner, against the third sealing surface of the inner tubular part, the connecting element being positioned in such a way that the gas passage opening of the first collar is in communication with the gas valve, so that gas under pressure can be forced through said at least one gas passage opening, separately from the beverage. Further, said at least one positioning means with an opening and/or an opening between at least two positioning means of the beverage valve assembly engages into a recess formed between the first and second collar of the connecting element.

A fifth object according to the present invention relates to a beverage tapping apparatus.

A general beverage tapping apparatus is described in WO-A1 03/050031 and is incorporated herein by reference.

The beverage tapping apparatus according to the present invention comprises a replaceable container with a beverage valve assembly according to the present invention releasably engaged with a connecting element of a tapping device according to the present invention, wherein the beverage valve assembly is provided on the side facing the inner bag with a gas passage opening to the inner space of the bag and on the opposite side is surrounded by an outer standing apron which is gas-tight, while along the inner sidewall of said apron, which functions as a first sealing surface, and at a distance therefrom at least one inner positioning means with an opening and/or an opening between at least two positioning means is arranged, and between said apron and said at least one positioning means a bottom wall with at least one gas valve is provided which during operation is in communication with the space enclosed between the inner bag and the container surrounding the inner bag via a gas passage, and a tubular part for receiving a dispensing element is arranged in the center, optionally surrounded by at least one standing positioning means with an opening and/or an opening between at least two positioning means, which positioning means of the beverage valve assembly engages into a recess formed between the first collar and second collar of the connecting element, which inner tubular part comprises a second sealing surface and a third sealing surface, the valve assembly being such that during operation a first collar of a connecting element according to the present invention abuts, in a gastight and liquid-tight manner, against the first sealing surface of the inner side of said apron and a second collar of said connecting element abuts, in a gastight and liquid-tight manner, against the second sealing surface of the tubular part, while a dispensing element abuts, in a gastight and liquid-tight manner, against the third sealing surface of the inner tubular part, the connecting element being positioned so that the gas passage opening of the first collar is in communication with the gas valve, so that gas under pressure can be forced through said at least one gas passage opening, separately from the beverage.

The tapping apparatus can comprise pressure means and/or chiller means. It is preferred that the tapping device with the connecting element is arranged on the beverage valve assembly, which is arranged on the container with an inner bag containing the beverage, so that the tapping apparatus functions as a housing for replaceably accommodating the tapping device with the connecting element arranged on the beverage valve assembly, which is arranged on the container with an inner bag containing the beverage.

Further advantageous embodiments of a beverage valve assembly, a connecting element, a tapping device and a beverage tapping apparatus according to the invention are further elucidated hereinbelow with reference to the drawings. In the description of the drawings, the first sealing surface is an inner wall section of the apron and the second and third sealing surfaces are an inner wall section of the tubular part of the beverage valve assembly. The same applies to the claims where first-, second- and third sealing surfaces are mentioned.

Figure 1:
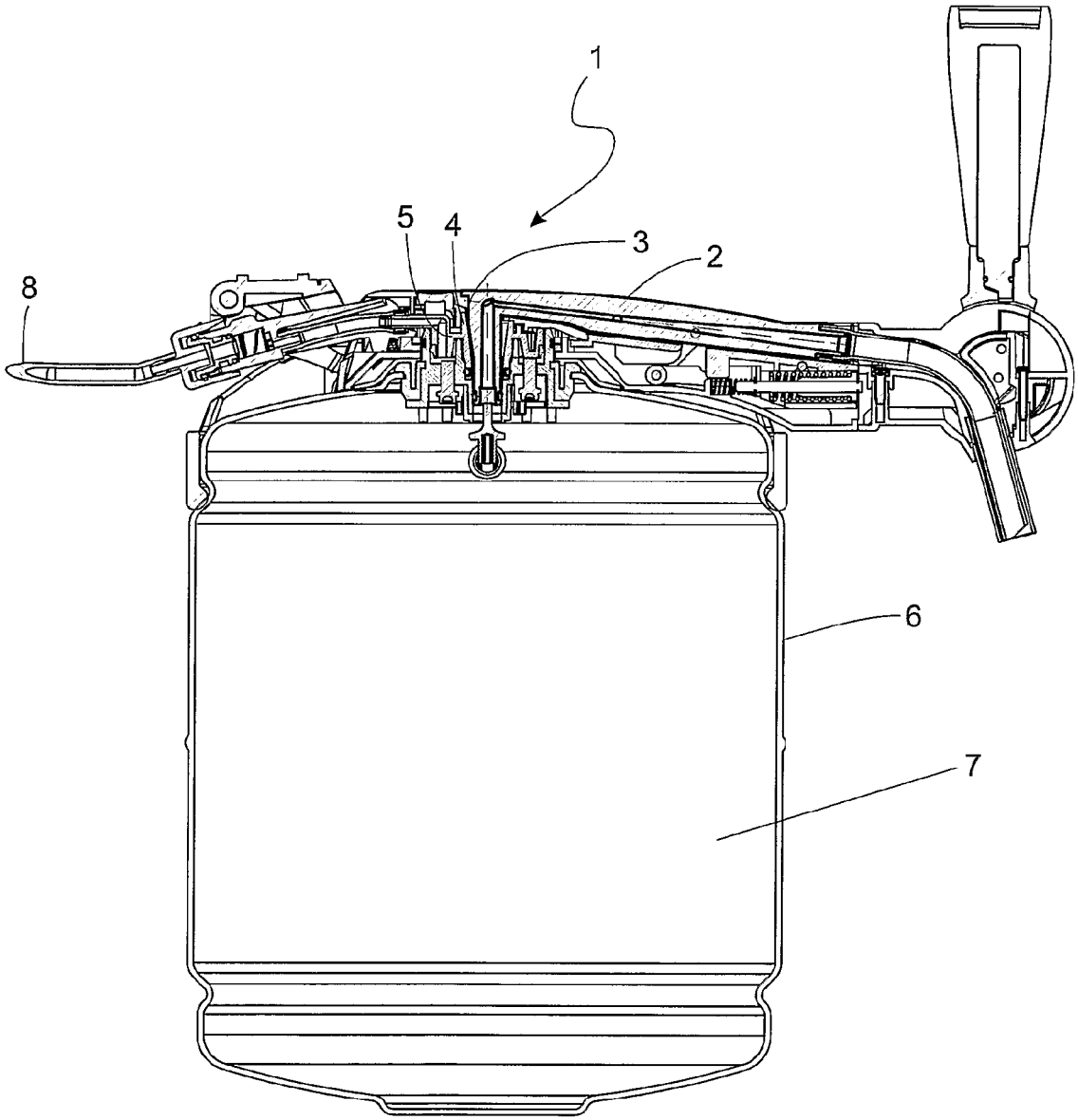
FIG. 1 is a sectional side elevation of a beverage tapping apparatus according to the present invention.
Figure 4A:
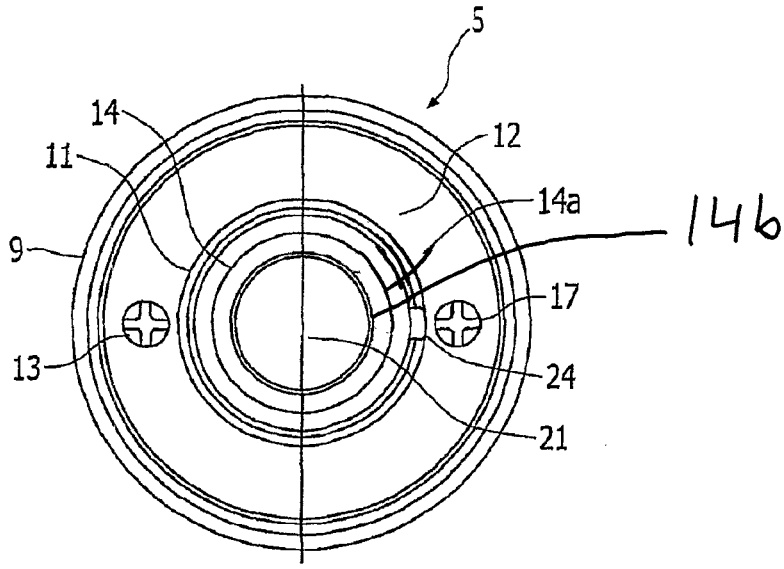
Figure 4B:
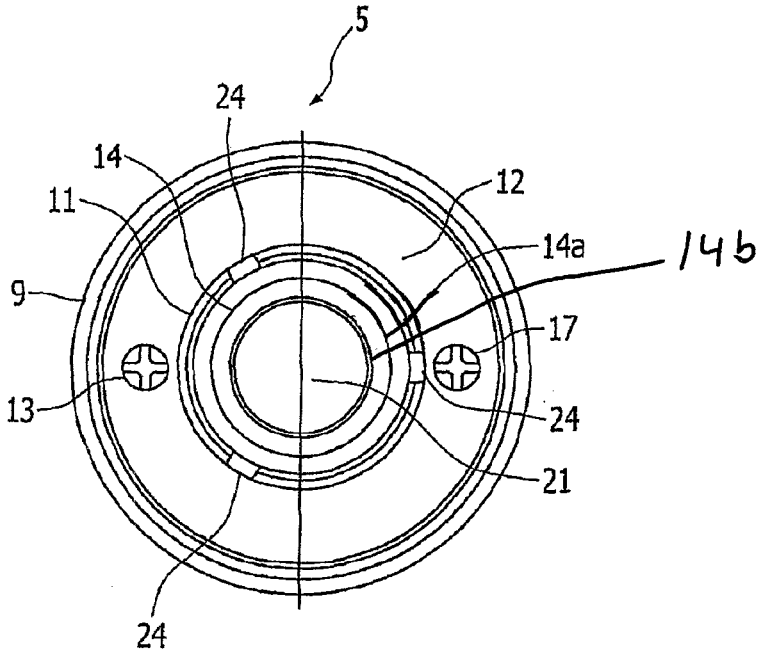
Figure 5:
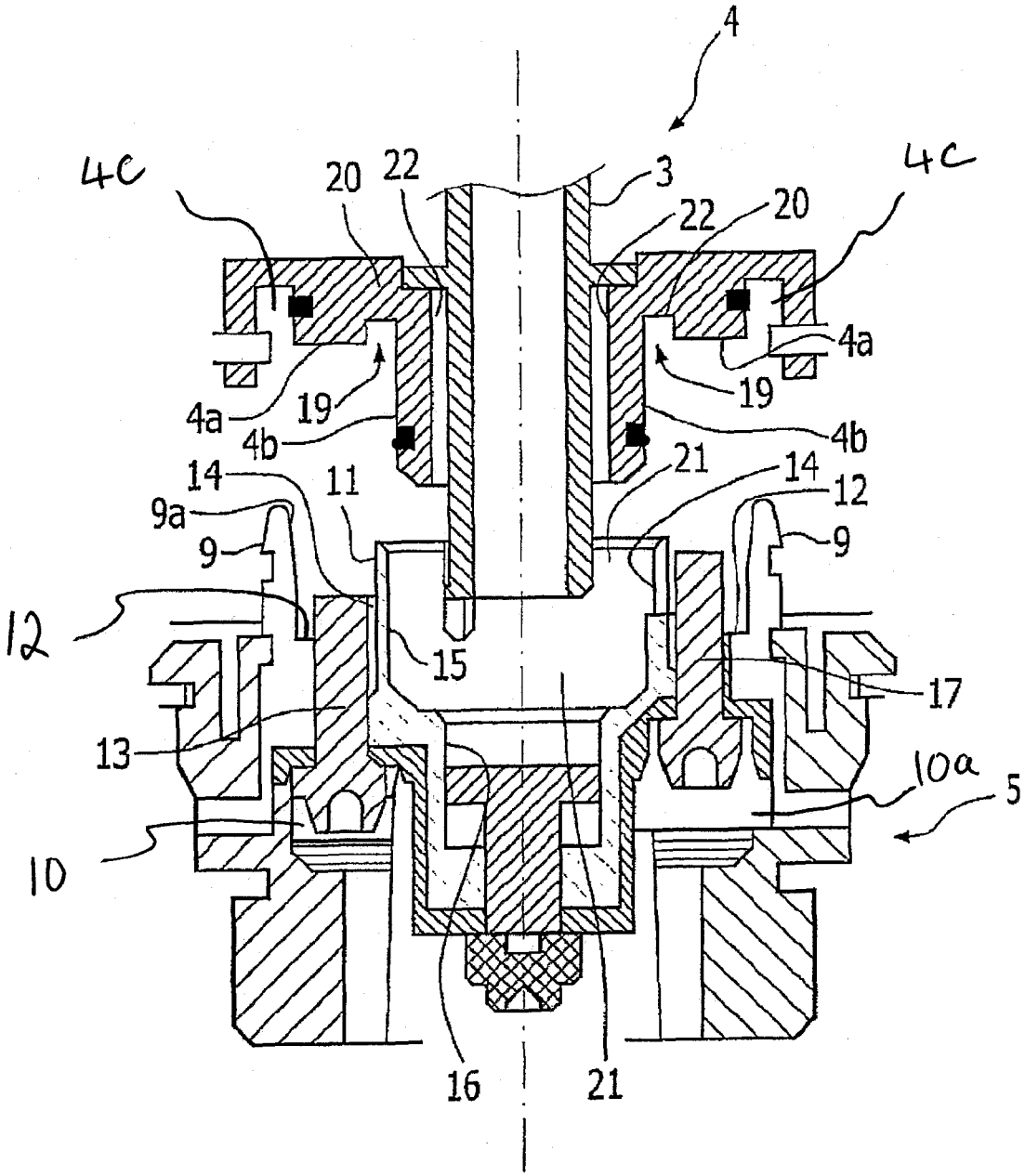
Figure 6:
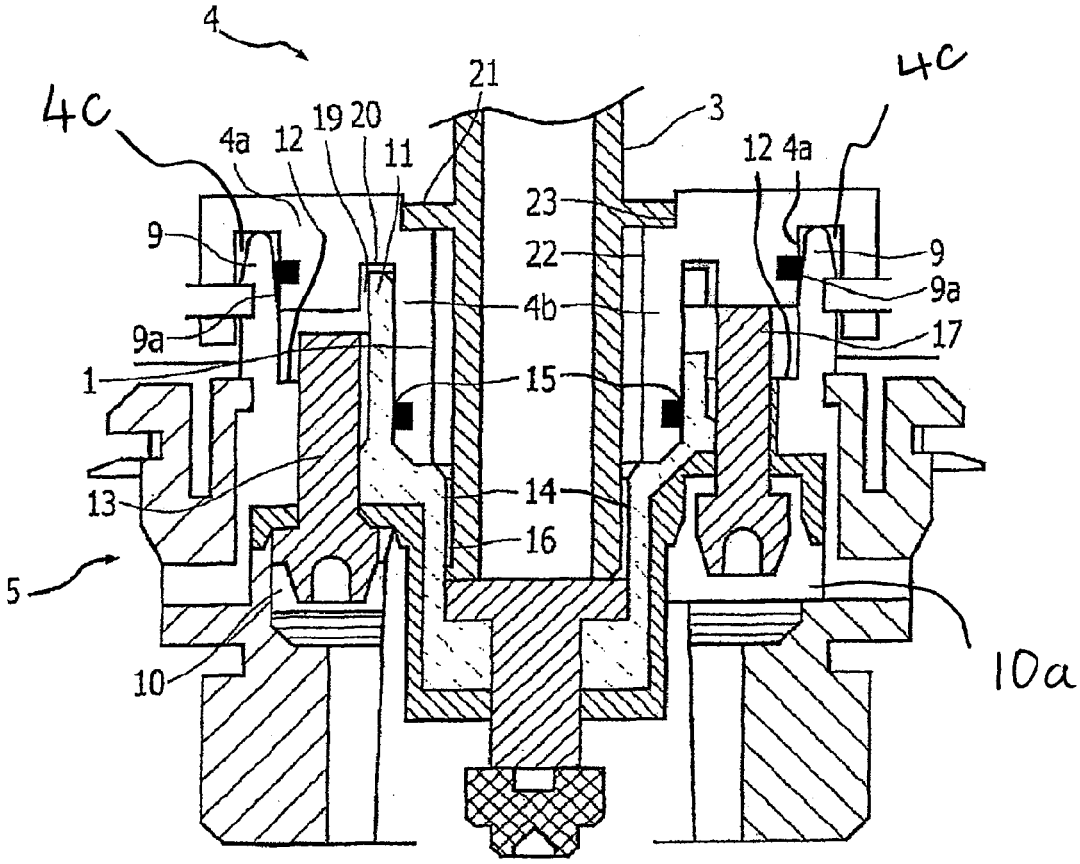

FIG. 4*a* is a top-side sectional side elevation of a beverage valve assembly according to the present invention with one opening of a positioning means;

FIG. 4*b* is a top-side sectional side elevation of a beverage valve assembly according to the present invention with three openings between three positioning means;

FIG. 5 is a sectional side elevation of a beverage valve assembly and a connecting element according to the present invention before they are joined to each other FIG. 6 is a sectional side elevation of a beverage valve assembly and a connecting element according to the present invention which are releasably joined to each other;

In the drawing, FIG. 1 shows in a sectional side elevation a beverage tapping apparatus (1) according to the present invention with a tapping device (2) and a dispensing element (3), wherein the tapping device with the connecting element (4) is releasably joined to the beverage valve assembly (5) connected to a container (6) in which an inner bag (7) is provided for receiving beverage. The container can be placed on a chiller plate, not shown. Further, the tapping device can be connected to pressure means (8).

Figure 2:
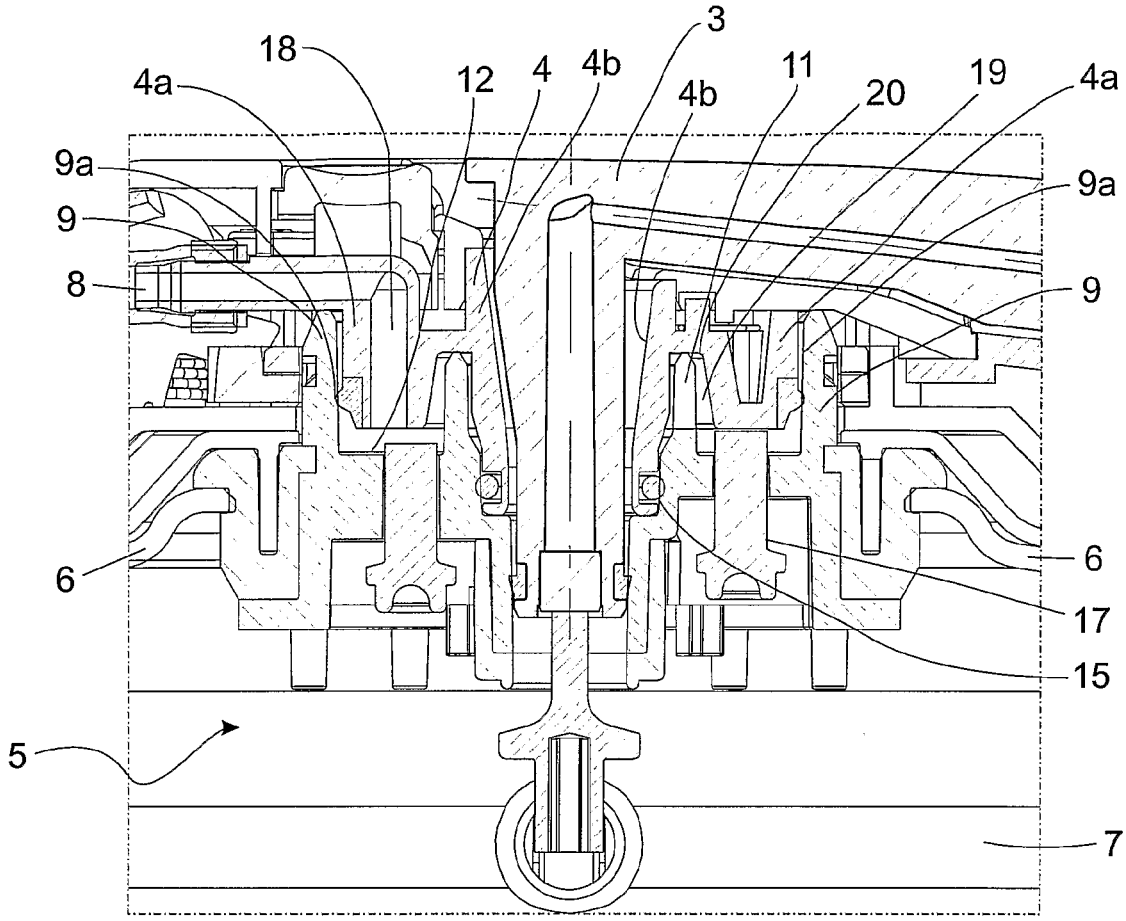
FIG. 2 is a cutout of the sectional side elevation of FIG. 1.

In the drawing, FIG. 2 shows a cutout of the sectional side elevation of FIG. 1 in which the beverage valve assembly (5) according to the present invention is arranged on a container (6) in which an inner bag (7) is provided for receiving beverage, such as beer. The beverage valve assembly (5) is provided on the side facing the inner bag (7) with a first gas passage opening (10*a*) (shown in FIG. 6) to the inner space of the bag (7) and on the opposite side is surrounded by an outer standing apron (9) which is gas-tight, while along the inner sidewall of said apron (9), which functions as a first sealing surface (9*a*), and at a distance therefrom, an inner circular positioning means (11) with a vertical gap (24) (shown in FIG. 4*a*) is arranged, while between said apron (9) and said positioning means (11) a bottom wall (12) with a gas valve (13) and a $CO_2$-valve (17) are arranged, as shown in FIGS. 5 and 6. As shown in FIGS. 5 and 6, during operation, the $CO_2$-valve (17) is in communication with the inner space of the bag (7) via the first gas passage opening (10*a*), and the gas valve (13) is in communication with the space enclosed between the inner bag (7) and the container (6) surrounding the inner bag via a second gas passage (10). As shown in FIGS. 2, 5 and 6, a tubular part (14) for receiving a dispensing element (3) is arranged in the center of the beverage valve assembly (5), surrounded by the standing positioning means (11) with a vertical gap (24) (shown in FIG. 4*a*), which inner tubular part (14) comprises a second sealing surface (15) and a third sealing surface (16). The valve assembly (5) is assembled such that during operation a first collar (4*a*) of a connecting element (4) abuts, in a gastight and liquid-tight manner, against the first sealing surface (9*a*) of the inner side of said apron (9) and a second collar (4*b*) of said connecting element (4) abuts, in a gastight and liquid-tight manner, against the second sealing surface (15) of the tubular part (14), while a dispensing element (3) abuts against the third sealing surface (16) of the inner tubular part (14) in a gastight and liquid-tight manner, the connecting element (4) being positioned in such a way that a gas passage opening (18) (shown in FIG. 2) of the first collar (4*a*) is in communication with the gas valve (13), so that gas under pressure can be forced through the first gas passage opening (10) (shown in FIG. 6) to the space enclosed between the bag (7) and the container (6), separately from the beverage. Further, as shown in FIGS. 2, 5, and 6, the connecting element (4) as described above comprises a first collar (4*a*) and a second collar (4*b*), and includes a first or outer recess (4*c*) and a second or inner recess (19). The second or inner recess (19) has a recess bottom (20) into which a circular positioning means (11) with a vertical gap (24) (shown in FIG. 4*a*) engages being situated between the first collar (4*a*) and the second collar (4*b*). Further, the second collar (4*b*) of the connecting element (4) has a through-hole in the center through which the dispensing element (3) is passed.

Figure 3:
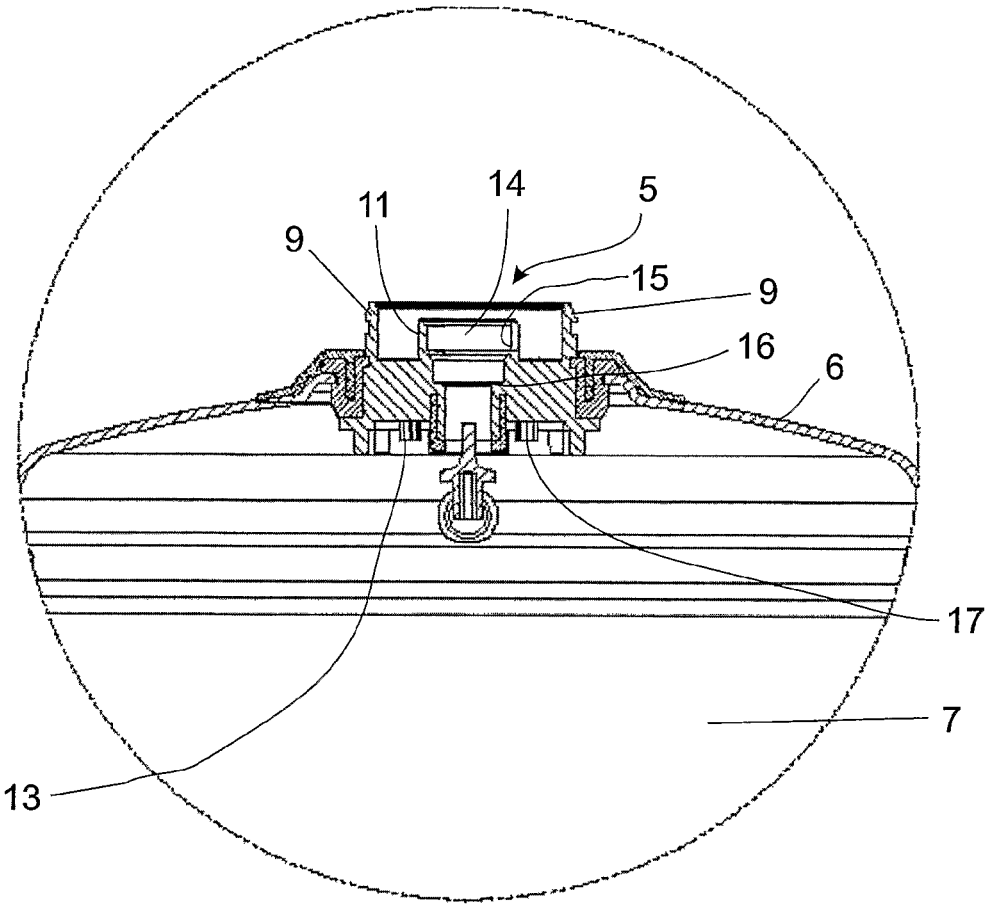
FIG. 3 is a sectional side elevation of a beverage valve assembly according to the present invention arranged on a container.

In the drawing, FIG. 3 shows in a sectional side elevation a beverage valve assembly (5) according to the present invention arranged on a container (6) in which an inner bag (7) is provided for receiving beverage, such as beer. The beverage valve assembly (5) is provided on the side facing the inner bag (7) with the second gas passage opening (10*a*) (shown in FIG. 6) to the inner space of the bag (7) and on the opposite side is surrounded by an outer standing apron (9) which is gas-tight, while along the inner sidewall of said apron, which functions as a first sealing surface, and at a distance therefrom, an inner circular positioning means (11) with a vertical gap (24) is arranged, and between said apron (9) and said positioning means (11) with a vertical gap (24), a bottom wall (12) with at least one gas valve (13) and at least one $CO_2$-valve (17) is provided. During operation, the gas valve (13) is in communication with the space enclosed between the inner bag and the container surrounding the inner bag via a gas passage, a tubular part (14) for receiving a dispensing element (3) being arranged in the center, surrounded by the standing positioning means (11) with a vertical gap (24), said inner tubular part (14) comprising a second sealing surface (15) and a third sealing surface (16).

In the drawing, FIG. 4*a* shows in a top-side sectional side elevation a beverage valve assembly (5) with a bottom wall (12), a tubular part (14) extending downward from the bottom wall (12) and an outer circular apron (9) extending upward from the bottom wall (12), wherein the tubular part (14) has a top opening (21) to receive a dispensing element (3), which top opening (21) is preferably arranged in the middle section of the upper outer surface of the bottom wall (12), and the tubular part (14) has an upper inner tubular wall section with at least one sealing surface, wherein an upper section of the inner tubular part is step and/or shoulder-shaped (14*a*), and the outer standing apron (9) is arranged at a distance from the top opening (21) of the tubular part (14), wherein the bottom wall (12) comprises a gas-valve (13) and a $CO_2$-valve (17) positioned between the top opening (21) of the tubular part (14) and an inner sidewall section of the outer standing apron (9), and wherein a circular positioning means (11) with one vertical gap (24) surrounds the top opening (21). As shown in FIG. 4*a*, a second step and/or shoulder-shaped (14*b*) may be provided at a lower section of the inner tubular part (14).

In the drawing, FIG. 4*b* shows in a top-side sectional side elevation a beverage valve assembly (5) according to another embodiment. Instead of having the single positioning means (11) of the embodiment shown in FIG. 4*a*, in the embodiment shown in FIG. 4*b*, there are three partly circular positioning means (11), with three vertical gaps (24) between the three positioning means (11), surround the top opening (21).

In the drawing, FIG. 5 shows in a sectional side elevation a beverage valve assembly (5) and a connecting element (4) according to the present invention before they are joined to each other. As shown in FIG. 5, the connecting element (4) includes a first or outer recess (4*c*) and a second or inner recess (19). The beverage valve assembly (5) has a bottom wall (12), a tubular part (14) extending downward from the bottom wall (12) and an outer circular apron (9) extending upward from the bottom wall (12), wherein the tubular part (14) has a top opening (21) to receive a dispensing element (3), which top opening (21) is preferably arranged in the middle section of the upper outer surface of the bottom wall (12), and the tubular part (14) has an upper inner tubular wall section with a second sealing surface (15) and third sealing surface (16), and the outer circular standing apron (9) with a first sealing surface (9*a*) is arranged at a distance from the top opening (21) of the tubular part (14), wherein the bottom wall (12) comprises a gas-valve (13) and a $CO_2$-valve (17) positioned between the top opening (21) of the tubular part (14) and an inner sidewall section of the outer standing apron (9), and wherein the circular positioning means (11) with a vertical gap (24) (shown in FIG. 4*a*) surrounds the top opening (21). The connecting element (4) as described above comprises a first collar (4*a*) and a second collar (4*b*) with a through-hole (22) in the center through which the dispensing element (3) is passed, wherein between the first collar (4*a*) and the second collar (4*b*) the second or outer recess (19) with a recess bottom (20) is formed into which a circular positioning means (11) with a vertical gap (24) (shown in FIG. 4*a*) can engage.

In the drawing, FIG. 6 shows in a sectional side elevation a beverage valve assembly (5) and a connecting element (4) according to the present invention, which are joined to each other. The beverage valve assembly (5) according to the present invention is arranged on a container (6) in which an inner bag (7) is provided for receiving beverage, such as beer. The beverage valve assembly (5) is provided on the side facing the inner bag (7) with a gas passage opening (10) to the inner space of the bag (7) and on the opposite side is surrounded by an outer standing apron (9) which is gas-tight, while along the inner sidewall (9*a*) of said apron (9), which functions as a first sealing surface (9*a*), and at a distance therefrom, an inner circular positioning (11) means is arranged, and between said apron (9) and said positioning means (11) with a vertical gap (24) (shown in FIG. 4*a*) a bottom wall (12) with a gas valve (13) and a $CO_2$-valve (17) are arranged, which gas valve (13), during operation, is in communication with the space enclosed between the inner bag (7) and the container (6) surrounding the inner bag via the first gas passage (10), wherein a tubular part (14) for receiving a dispensing element (3) is arranged in the center of the beverage valve assembly (5), surrounded by the standing positioning means (11) with a vertical gap (24) (shown in FIG. 4*a*), which inner tubular part (14) comprises a second sealing surface (15) and a third sealing surface (16). The valve assembly (5) is assembled such that during operation a first collar (4*a*) of a connecting element (4) abuts against the first sealing surface (9*a*) of the inner side of said apron (9), in a gastight and liquid-tight manner, and a second collar (4*b*) of said connecting element (4) with a through-hole (22) in the center through which the dispensing element (3) is passed abuts, in a gastight and liquid-tight manner, against the second sealing surface (15) of the tubular part (14), while a dispensing element (3) abuts, in a gastight and liquid-tight manner, against the third sealing surface (16) of the inner tubular part (14), the connecting element (4) being positioned in such a way that the gas passage opening (18) (shown in FIG. 2) of the first collar (4*a*) is in communication with the gas valve (13), so that gas under pressure can be forced through the first gas passage opening (10) to the space enclosed between the bag (7) and the container (6), separately from the beverage. Further, as shown in FIG. 6, the second collar (4*b*) with the through-hole (22) has a step (23) on its upper top section to hold the dispensing element (3).

A sixth object of the present invention is directed to a method for dispensing beer from a beverage tapping apparatus.

The method for dispensing beer from a beverage tapping apparatus comprises a number of steps in which, after fitting the connecting element according to the present invention to a beverage valve assembly according to the present invention arranged on a container with an inner bag containing the beverage, the container is placed into a tapping apparatus, preferably with a chiller plate, and subsequently a gas is introduced through at least one gas passage opening between the inner bag and the surrounding container for compressing the inner bag, thereby displacing the beverage present in the inner bag upon the opening of the beverage valve.

The invention claimed is:

1. A beverage valve assembly for connection to a connecting element having a first recess and a second recess, the beverage valve assembly comprising:

a bottom wall section;

a tubular part extending downward from the bottom wall section;

an outer apron extending upward from the bottom wall section and being positioned in the first recess of the connecting element; and a positioning device having a standing wall configured for insertion in the second recess of the connecting element when the beverage valve assembly is in a connected position with the connecting element, wherein the tubular part has a top opening to receive a dispensing element, the top opening being arranged in a middle section of the bottom wall, and the tubular part having an upper inner tubular wall section with at least one sealing surface, and the outer apron is arranged at a distance from the top opening of the tubular part, wherein the bottom wall section comprises at least one valve positioned between the top opening of the tubular part and an inner sidewall section of the outer apron, wherein the positioning device has a gap separating a portion of the positioning device into at least two standing walls separated by the gap, wherein the upper inner tubular wall section is annularly shaped and comprises a first shoulder and a second shoulder, the second shoulder being arranged below the first shoulder, and a diameter of the top opening within the first shoulder is substantially larger than a diameter of a lower opening of the tubular part within the second shoulder, and wherein, in the connected position, the standing wall is separated from the dispensing element by a wall of the connecting element partially surrounding the dispensing element.

2. The beverage valve assembly according to claim 1, wherein the standing wall at least partly surrounds the top opening of the tubular part.

3. The beverage valve assembly according to claim 1, wherein the inner sidewall section of said outer apron functions as a first sealing surface, so that the connecting element is able to abut, in a gastight and liquid-tight manner, against the first sealing surface of the inner sidewall section of said outer apron.

4. The beverage valve assembly according to claim 1, wherein the outer apron and the positioning device are arranged concentrically with respect to the top opening.

5. The beverage valve assembly according to claim 1, wherein the at least one valve comprises a first valve and a second valve, wherein the bottom wall comprises the first valve and the second valve, wherein the first valve is connected to a passage to a space between a keg and a bag, and the second valve is connected to a further passage to an inner part of the bag, and wherein the first valve is an air valve and the second valve is a $CO_2$-valve, and wherein the valves are radially spaced apart, located on a same normal to a circle and equidistant from a center point, and the first valve and the second valve are arranged in the bottom wall section between the inner sidewall section of said outer apron and the top opening of the tubular part.

6. The beverage valve assembly according to claim 1, wherein an internal diameter of the outer apron is 10 mm to 100 mm; and a height of the outer apron, measured from an upper outer surface of the bottom wall adjacent to the outer apron, is 0.5 mm to 50 mm; and a thickness of the outer apron is 0.1 mm to 15 mm.

7. The beverage valve assembly according to claim 1, wherein an internal diameter of the at least one positioning device is 0.5 mm to 50 mm; and a height of the positioning device, measured from an upper outer surface of the bottom wall adjacent to the outer apron, is 0.5 mm to 50 mm; and a thickness of the positioning device is 0.1 mm to 15 mm.

8. The beverage valve assembly according to claim 1, wherein a diameter of an opening of the outer apron facing away from the bottom wall is 0.5 mm to 50 mm; and a diameter of the an opening of the positioning device facing away from the bottom wall is 0.5 mm to 50 mm.

9. The beverage valve assembly according to claim 1, wherein an internal diameter of the top opening of the tubular part is 0.5 mm to 50 mm; and a diameter of a further opening of the tubular part below the top opening is 0.5 mm to 50 mm.

10. The beverage valve assembly according to claim 1, wherein a width of an upper outer surface of an annularly shaped first shoulder that forms the top opening is 0.5 mm to 50 mm; and a width of an annularly shaped second shoulder that forms a further opening below the top opening is 0.5 mm to 50 mm.

11. The beverage valve assembly according to claim 1, wherein a distance between an annularly shaped first shoulder that forms the top opening and an annularly shaped second shoulder that forms a further opening below the top opening is 0.1 mm to 50 mm.

12. The beverage valve assembly of claim 1, wherein the positioning device has two gaps separating the portion of the positioning device into three standing walls.

* * * * *